US008336181B2

(12) United States Patent
Corre et al.

(10) Patent No.: US 8,336,181 B2
(45) Date of Patent: Dec. 25, 2012

(54) FIBER REINFORCED PACKER

(75) Inventors: Pierre-Yves Corre, Abbeville (FR); Gilles Carree, Regniere-Ecluse (FR); Guillaume Boutillon, Abbeville (FR); Zeynep Alpman, Abbeville (FR); Stephane Metayer, Abbeville (FR); Jean-Louis Pessin, Amiens (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 333 days.

(21) Appl. No.: 12/632,461

(22) Filed: Dec. 7, 2009

(65) Prior Publication Data

US 2011/0036597 A1 Feb. 17, 2011

Related U.S. Application Data

(60) Provisional application No. 61/232,820, filed on Aug. 11, 2009.

(51) Int. Cl.
*B23P 17/00* (2006.01)
*E21B 33/12* (2006.01)

(52) U.S. Cl. ..... 29/419.1; 166/387

(58) Field of Classification Search ..... 29/429.1, 29/428, 450, 451, 455.1, 458, 460, 234; 166/387, 166/138, 187, 179, 118; 277/334
See application file for complete search history.

(56) References Cited

U.S. PATENT DOCUMENTS

| | | | | |
|---|---|---|---|---|
| 2,441,894 | A | | 5/1948 | Mennecier |
| 2,511,759 | A | | 6/1950 | Williams |
| 2,581,070 | A | | 1/1952 | Blood |
| 2,600,173 | A | | 6/1952 | Sewell et al. |
| 2,623,594 | A | | 12/1952 | Sewell |
| 2,675,080 | A | | 4/1954 | Williams |
| 2,742,968 | A | | 4/1956 | Hildebrandt |
| 2,842,210 | A | | 7/1958 | Ramsey |
| 2,843,208 | A | | 7/1958 | Blood |
| 3,915,229 | A | | 10/1975 | Nicolas |
| 3,926,254 | A | | 12/1975 | Evans et al. |
| 4,236,113 | A | | 11/1980 | Wiley |
| 4,349,204 | A | | 9/1982 | Malone |
| 4,500,095 | A | | 2/1985 | Schisler et al. |
| 4,830,105 | A | | 5/1989 | Petermann |
| 4,886,117 | A | | 12/1989 | Patel |
| 4,923,007 | A | | 5/1990 | Sanford et al. |
| 5,340,626 | A | * | 8/1994 | Head ..... 277/334 |
| 5,358,039 | A | | 10/1994 | Fordham |
| 5,361,836 | A | | 11/1994 | Sorem et al. |
| 5,404,947 | A | | 4/1995 | Sorem et al. |
| 5,439,053 | A | | 8/1995 | Eslinger et al. |
| 5,507,341 | A | | 4/1996 | Eslinger et al. |

(Continued)

FOREIGN PATENT DOCUMENTS

| | | |
|---|---|---|
| EP | 0528327 | 2/1993 |

(Continued)

*Primary Examiner* — John C Hong
(74) *Attorney, Agent, or Firm* — John M. Vereb; Michael Flynn

(57) ABSTRACT

A technique enables construction of a simplified inflatable packer. An inflatable packer is constructed with a packer reinforcement layer having at least one fiber layer. The fiber layers provide both mechanical and anti-extrusion qualities in a relatively simple and small package. Depending on the desired application, the inflatable packer also comprises an inner bladder layer and other potential layers, such as an outer seal layer. Mechanical extremities are used to secure longitudinal ends of the various packer layers, including the packer reinforcement layer.

22 Claims, 4 Drawing Sheets

U.S. PATENT DOCUMENTS

| | | | |
|---|---|---|---|
| 5,605,195 | A | 2/1997 | Eslinger et al. |
| 5,613,555 | A | 3/1997 | Sorem et al. |
| 5,687,795 | A | 11/1997 | Patel et al. |
| 5,702,109 | A | 12/1997 | Mahin et al. |
| 6,315,050 | B2 | 11/2001 | Vaynshteyn et al. |
| 6,513,600 | B2 | 2/2003 | Ross |
| 6,564,876 | B2 | 5/2003 | Vaynshteyn et al. |
| 6,729,399 | B2 | 5/2004 | Follini et al. |
| 6,865,933 | B1 | 3/2005 | Einarson et al. |
| 6,938,698 | B2 | 9/2005 | Coronado |
| 7,510,015 | B2 | 3/2009 | Corre et al. |
| 2002/0014339 | A1 | 2/2002 | Ross |
| 2002/0017386 | A1 | 2/2002 | Ringgenberg et al. |
| 2004/0099443 | A1 | 5/2004 | Meister et al. |
| 2004/0216871 | A1 | 11/2004 | Mendez et al. |
| 2007/0289735 | A1 | 12/2007 | Corre et al. |

FOREIGN PATENT DOCUMENTS

| | | |
|---|---|---|
| EP | 0528328 | 2/1993 |
| EP | 0702747 | 3/1996 |
| WO | 03/018956 | 3/2003 |

* cited by examiner

FIBER REINFORCED PACKER

CROSS-REFERENCE TO RELATED APPLICATION

The present document is based on and claims priority to U.S. Provisional Application Ser. No. 61/232,820, filed Aug. 11, 2009.

BACKGROUND

Many types of packers are used in wellbores to isolate specific wellbore regions. A packer is delivered downhole on a conveyance and expanded against the surrounding wellbore wall to isolate a region of the wellbore. Once set against the surrounding wellbore wall, the packer can be subjected to substantial heat, pressures and forces. Consequently, flexible rubber packer layers can undergo undesirable extrusion which has a detrimental effect on the function of the packer.

Some inflatable packers are reinforced with metallic cables. For example, anti-extrusion layers may be constructed with metallic cables for cooperation with mechanical layers. Each packer layer tends to be made of materials having different properties causing differences in behavior when the packer is heated or inflated. Additionally, such packers tend to be complex to design and manufacture. Attempts have been made to design packers with fibers to strengthen specific packer layers. However such fibers often must be laid at increasing angles, relative to the axis of the packer, toward the packer extremities to ensure self locking. In some applications, this approach can result in an undesirable build-up of fibers at the packer extremity. Additionally, metallic wedges are sometimes required in the mechanical extremity to secure longitudinal ends of the fiber layers, however these wedges can be aggressive to fibers under load.

SUMMARY

In general, the present invention provides a system and method employing a simplified structure for an inflatable packer. An inflatable packer is designed with a packer reinforcement layer constructed from at least one fiber layer, e.g. two specific fiber layers with fibers set at opposed angles. The at least one fiber layer is able to provide both mechanical and anti-extrusion qualities in a relatively simple and thin package. The inflatable packer also comprises an inner bladder layer, and the packer may comprise other layers, such as an outer seal layer. Mechanical extremities are used to secure longitudinal ends of the various packer layers, including the packer reinforcement layer.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method which provide an inflatable packer manufactured with technical fibers, such as carbon fibers. In one embodiment, fiber is used to create a reinforcement layer which may comprise one or more fiber layers designed to serve both mechanical and anti-extrusion functions, thus obviating the need for additional mechanical or anti-extrusion layers. The fiber layers are designed to also ensure the packer will inflate with minimum twist. By way of example, the packer may have an expandable section that can be expanded, e.g. inflated, between two mechanical extremities. The expandable section is designed to expand radially outward for engagement with a surrounding wellbore wall, such as a wall formed by a casing or other tubular deployed in the wellbore or a wall of an open hole wellbore.

Although the overall packer may be formed as an inflatable packer with a variety of material layers, one embodiment generally comprises a plurality of expandable layers that are held at their opposed, longitudinal ends by the mechanical extremities. For example, the plurality of expandable layers may comprise an inner bladder layer, an outer seal layer, and a reinforcement layer between the inner bladder layer and the outer seal layer. The reinforcement layer comprises a fiber layer and often a plurality of fiber layers which perform as anti-extrusion and mechanical layers. The anti-extrusion function prevents extrusion of material from, for example, the inner bladder layer; and the mechanical function provides form and support for the overall packer while enabling expansion, e.g. inflation, of the packer in a radially outward direction. The anti-extrusion and mechanical functionality is achieved by employing high-performance fibers, such as carbon fibers, in constructing the one or more fiber layers of the reinforcement layer.

According to one embodiment, the reinforcement layer has a plurality of fiber layers which serve as anti-extrusion/mechanical layers, and the fiber layers are formed of the same material. The construction technique provides an inflatable packer with pressure resistance which is substantially improved over traditional cable packers. The orientation and arrangement of the fiber in creating the fiber layers also can affect the characteristics of the inflatable packer as explained in greater detail below.

Figure 1:
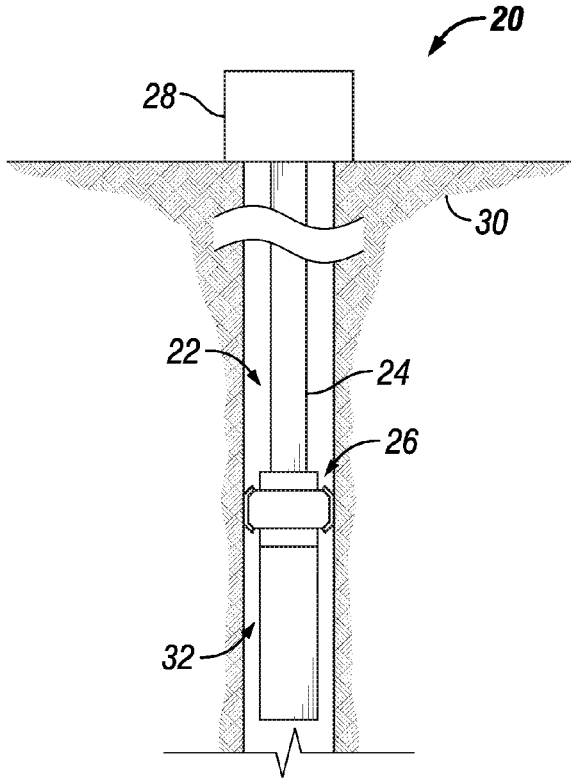
FIG. 1 is a schematic front elevation view of a well system having a packer and completion deployed in a wellbore, according to an embodiment of the present invention.

Referring generally to FIG. 1, one embodiment of a well system 20 is illustrated as deployed in a wellbore 22, however many other types of well systems may be designed with individual or multiple packers. The illustrated well system 20 comprises a conveyance 24 employed to deliver at least one packer 26 downhole to a desired wellbore location. In many applications, packer 26 is deployed by conveyance 24 in the form of a tubing string, but conveyance 24 may have other forms, including wirelines or slick lines, for other types of well applications. In the embodiment illustrated, conveyance 24 extends downhole from a wellhead 28 positioned at a surface location 30. The packer 26 cooperates with or is part of a completion 32.

Figure 2:
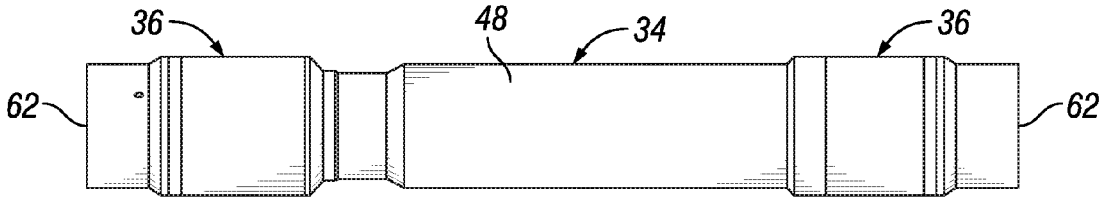
FIG. 2 is a front view of one example of the packer illustrated in FIG. 1, according to an embodiment of the present invention.

Packer 26 is designed with layers constructed in a manner which enhances its functionality in a harsh downhole environment while providing the packer with substantial longevity. As further illustrated in FIG. 2, packer 26 may comprise an inflatable packer having an expandable portion 34 formed of layers, including fiber layers, arranged to provide consistent actuation, dependability, longevity and ease-of-use in the wellbore environment. The expandable portion 34 is selectively expanded between mechanical extremities 36 which are designed to hold the longitudinal ends of the layers forming expandable portion 34.

Figure 3:
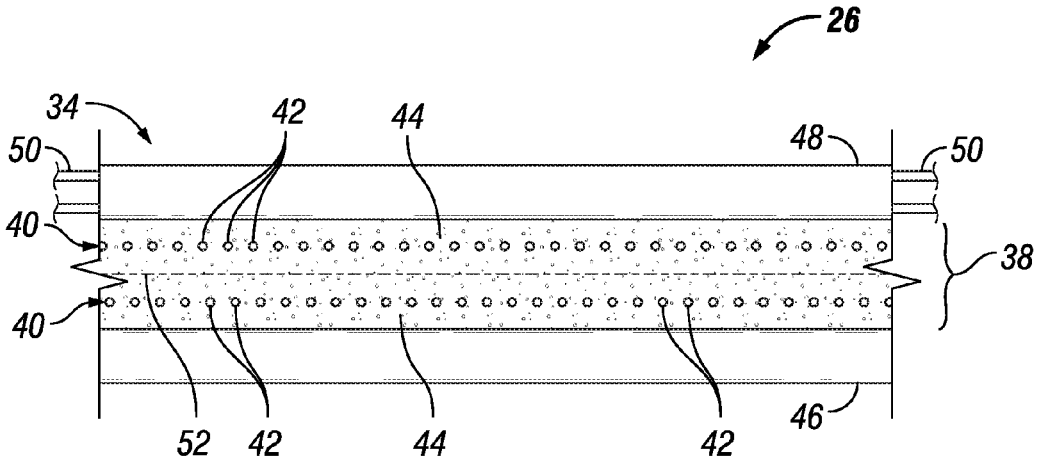
FIG. 3 is a partial, schematic cross-sectional view of one example of the packer illustrated in FIG. 1, according to an embodiment of the present invention.

In FIG. 3, one example of multiple layers that can be used to form the wall of expandable portion 34 is illustrated in partial cross-section. The partial cross-section is taken generally parallel with a longitudinal axis of packer 26 through the expandable portion 34 on one side of the packer 26. In this example, a reinforcement layer 38 is formed with a plurality of fiber layers 40 having fibers 42 arranged to enable fiber layers 40 to function as both mechanical and anti-extrusion layers. A lubricant 44 may be applied to the fibers 42 and/or between fiber layers 40 to facilitate inflation of packer 26 with minimal friction. Examples of suitable lubricants include organic lubricants and grease, such as silicon grease.

In the embodiment illustrated, an inner bladder layer 46 is positioned along an interior surface of reinforcement layer 38. An outer seal layer 48 may be positioned along an external surface of the reinforcement layer 38 to facilitate sealing of the packer against a surrounding wellbore wall. The inner bladder layer 46 and the outer seal layer 48 may be formed from elastomeric materials, such as rubbers used in constructing inflatable packers. In some applications, specific rubber layers, e.g. outer seal layer 48, may include reinforcing materials 50, such as particles, fibers, braids, cables, or other suitable reinforcing materials. The reinforcing materials 50, e.g. metallic cables, also may be utilized in helping secure the longitudinal ends of outer seal layer 48 to mechanical extremities 36. Because lubricant 44 can make it difficult to bond outer seal layer 48 to reinforcement layer 38, the reinforcing materials 50 may be useful as a mechanical layer within the outer seal layer 48 to facilitate gripping of the outer seal layer within mechanical extremities 36.

By way of example, the anti-extrusion and mechanical layers, i.e. fiber layers 40, may be made with a plurality of technical fibers, such as carbon fibers. The fibers 42 are set in a manner that prevents rubber from extruding between them, and the mechanical properties of the fibers are sufficient to provide packer strength throughout the life of the packer 26 in well environments. According to one embodiment, fibers 42 are carbon fibers which have substantial resistance to chemicals, temperature and creep. These characteristics allow carbon fiber layers 40 to be employed in many high-temperature well environments. However, other technical fibers 42 may be used in a variety of well applications, and examples of such technical fibers include Kevlar™ fibers glass fibers, thermoplastic fibers, or metallic fibers. However, metallic fibers sometimes require a size which reduces their ability to provide an efficient anti-extrusion barrier.

The elastomeric material used to construct packer 26, e.g. to construct inner bladder layer 46 and outer seal layer 48, may comprise a rubber material exhibiting sufficient temperature, elongation, and chemical resistance to enable its use in a well environment. Examples of suitable rubber materials include hydrogenated nitrile butadiene rubber (HNBR) including HNBR with a high acrylonitrile (ACN) content. In some applications, e.g. lower temperature well applications, the rubber material may be formed with nitrile butadiene rubber (NBR).

The longevity and functionality of expandable portion 34 is affected by the manner in which the various layers are constructed. For example, the lubricant 44 may be set between fibers 42 and between fiber layers 40 to facilitate packer inflation with minimal friction. According to one embodiment, no rubber layer is disposed between the fiber layers 40, and the fibers 42 are free of any resin or thermoplastic impregnation in the center or middle region of the packer between mechanical extremities 36. The use of lubrication, e.g. organic grease or silicon grease, enables the free and repeated functioning of expandable portion 34 without risk of breaking fibers. The lubrication also can serve to eliminate any potential need to add other materials, e.g. resin, thermoplastic materials or rubber sheets, to the fiber layers 40 in the expansion region between mechanical extremities 36.

The fibers 42 are set at a desired angle with respect to the longitudinal axis of packer 26 to facilitate packer expansion. Generally, the setting angle should be high enough to ensure homogeneous expansion and, in at least some embodiments, this may be accomplished by setting the angle of the fibers along the length of the packer at an angle between 5° and 20°. In some applications, the fiber setting angle can be changed within the mechanical extremities 36 to, for example, improve retention of the longitudinal ends of the reinforcement layer 38 within the mechanical extremities.

Reinforcement layer 38 also is designed with sufficient thickness to ensure packer 26 does not break under pressure after repeated cycling and to avoid any negative effects on the performance of fibers 42 with respect to providing both mechanical and anti-extrusion functionality. By way of one specific example, the reinforcement layer 38 comprises fiber layers constructed with carbon fibers wrapped or otherwise deployed to a total thickness between 8 mm and 16 mm. The thickness may be selected such that the fibers 42 will be stressed between 20% and 50% of their measured breaking force when packer 26 is subjected to pressure corresponding with its full pressure rating. Of course, the number of fiber layers and the overall thickness of reinforcement layer 38 may be affected by the environment, the specific well application, and the type of fiber employed in creating fiber layers 40. The use of carbon fibers and/or other suitable technical fibers enables construction of a relatively thin reinforcement layer 38 which is solely capable of providing complete mechanical and anti-extrusion functionality.

The desired thickness of reinforcement layer 38 may be achieved by creating multiple layers of fibers 42. In one example, the total reinforcement layer thickness is composed of a plurality of unidirectional fibers which are set helicoidally around the packer and in multiple fiber layers 40. In this embodiment, each fiber 42 of each fiber layer 40 is set at a precise angle which is constant along the packer length, at least along the length of reinforcement layer 38 which undergoes expansion between mechanical extremities 36. The setting angles of fibers 42 are such that the angle of a given fiber layer 40 is smaller than the setting angle of a radially outward fiber layer 40. The setting angles of fibers 42 in adjacent fiber layers 40 also may be in opposite directions, e.g. plus xx° and minus yy°, to ensure the packer has minimal twist during inflation. In one specific example, the relative setting angles of fibers 42 in one layer may be approximately +19.5° and in the other layer approximately −20.3°. The setting angles may be calculated for each layer to ensure the shortening ratio of each fiber is substantially identical, and this ensures a homogeneous force distribution on all fibers 42 when packer 26 is set in a generally cylindrical wellbore. The setting angles of the fibers 42 may be selected such that the setting angle at any given diameter of the reinforcement layer 38 is identical/constant to ensure homogeneous inflation.

In some embodiments, the fiber angle in each layer 40 is calculated precisely relative to the fiber angle in the one or more other fiber layers 40. With a thick carbon fiber reinforcement layer 38, for example, the fiber angle in each layer 40 may be progressively increased from the inside diameter to the outside diameter. The change in fiber angle from one fiber layer 40 to the next ensures that every fiber shortens in the same way and the loading on the fibers is distributed evenly. In this embodiment, the setting angle of the fibers also may be opposed from one layer to the next to prevent packer twist, e.g. one fiber layer 40 may have a fiber setting angle of +xx° while another fiber layer 40 has a fiber setting angle of −yy°.

In some embodiments, an additional anti-friction layer 52 may be set between fiber layers 40, e.g. between carbon fiber layers. The anti-friction layer 52 may be employed in certain environments or applications to help ensure a reliable shortening ratio. In this embodiment, the anti-friction layer 52 is not a rubber layer but rather a very thin layer resistant to creep. Examples of materials which can be used to create anti-friction layer 52 include high temperature, low friction coefficient materials, such as fluorinated thermoplastic end and similar materials, e.g. polytetrafluoroethylene (PTFE), perfluoroalkoxy copolymer resin (PFA), tetrafluoroethylene (TFE), and other suitable low friction materials.

The mechanical extremities 36 are designed to hold the longitudinal ends of reinforcement layer 38 and other expandable layers, such as inner bladder layer 46 and outer seal layer 48. Each mechanical extremity 36 may be constructed from temperature and chemical resistant materials, such as metal materials. However, some components, such as an anti-expansion ring, may be constructed from composite materials which can make packer drilling easier when required.

Figure 4:
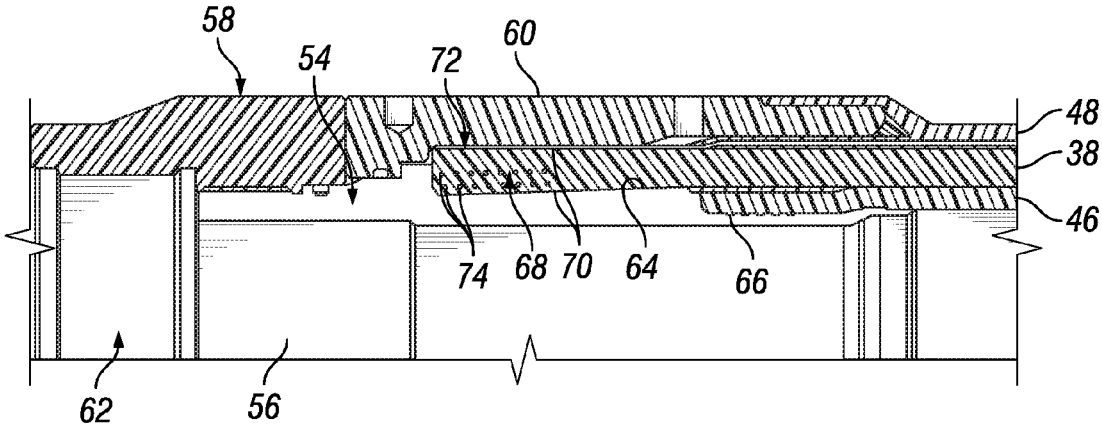
FIG. 4 is a partial cross-sectional view of one example of the packer illustrated in FIG. 1 showing packer layers captured in one of the mechanical extremities, according to an embodiment of the present invention.

Referring generally to FIG. 4, one example of a mechanical extremity 36 is illustrated at one end of the packer 26 as gripping the longitudinal ends of reinforcement layer 38, inner bladder layer 46, and outer seal layer 48. In this embodiment, the mechanical extremity 36 comprises an inner packer nipple 54 which may have a generally cone shape and an interior passage 56. The illustrated mechanical extremity 36 also comprises an outer skirt 58 which may include an anti-expansion ring 60. Basically, the inner packer nipple 54 and outer skirt 58 cooperate to hold and retain longitudinal ends of the packer layers which form expandable portion 34. Each mechanical extremity 36 also may comprise other components, such as end connectors 62 by which packer 26 may be connected into a tubing string, completion, or other well equipment.

In the embodiment illustrated in FIG. 4, the reinforcement layer 38, inner bladder layer 46, and outer seal layer 48 are individually captured and gripped between inner packer nipple 54 and anti-expansion ring 60. For example, inner packer nipple 54 may have retention surfaces 64, 66 for gripping reinforcement layer 38 and inner bladder layer 46, respectively. Additionally, retention of reinforcement layer 38 may be enhanced by employing a resin material 68 in combination with fibers 42 at the longitudinal ends of reinforcement layer 38. By way of example, resin material 68 comprises a polymerized high-performance thermoset resin, e.g. an epoxy resin. However, other materials, e.g. cyanate esters, bismaleimide, and benzoxazine, also may be used in combination with the fibers 42 within each mechanical extremity 36 to enhance the packer resistance to high temperature. Additionally, the resin material 68 may be used to enhance bonding efficiency at bonding interfaces 70 along each longitudinal end of reinforcement layer 38.

As illustrated, retention surface 64 of the inner packer nipple 54 may be oriented at an incline to accommodate and/or help form each longitudinal end of the reinforcement layer 38 into a wedge shaped end 72. The composite formed by fibers 42 and resin material 68 can be formed in the wedge shape 72 with a thicker portion of the wedge being toward the extremities of the fiber reinforcement layer 38. The wedge shaped end 72 can be used to facilitate better gripping efficiency. According to one embodiment, the composite wedge shape is set with the resin and fiber percentage constant along the entire wedge shaped end 72. A desired percentage of resin and fiber may be achieved by wrapping additional fibers 74 through portions of wedge shaped end 72 and/or by increasing the fiber angle locally to thicken the longitudinal end of reinforcement layer 38 towards its extremity.

The length of the mechanical extremities 36 may be appropriately adjusted to ensure that local shear stress between the composite end of reinforcement layer 38 and the surrounding components does not exceed the shear resistance of the resin material 68. The wedge shaped end 72, however, can aid in providing good mechanical handling even if the shear stress exceeds resin shear resistance. Selection of appropriate resins also can facilitate desired long term mechanical functionality. The resin 68 selected to impregnate fibers 42 within each mechanical extremity 36 is formulated to ensure mechanical stiffness and sufficient resistance to temperature, chemicals and other downhole parameters. In some embodiments, different resins are selected depending on whether the resins tend to contact metal materials or other materials, e.g. composite materials, to ensure better bonding properties. In some applications, for example, plasticized resin exhibits better shear stress resistance and allows local displacement without breaking.

Figure 5:
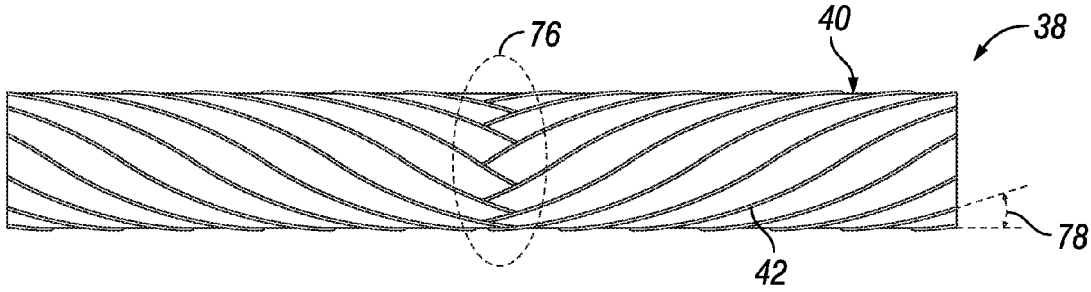
FIG. 5 is a schematic representation of one fiber layer of a reinforcement layer utilized in the packer, according to an embodiment of the present invention.

The longevity and functionality of the reinforcement layer 38 is affected not only by formation of its longitudinal ends, but also by the arrangement of the fiber or fibers in the center region between mechanical extremities 36. In one embodiment, for example, the fibers 42 are set with a filament winding machine which wraps a single fiber 42 to create an individual fiber layer 40 of reinforcement layer 38. The filament winding machine may be programmed so the fiber of a given fiber layer 40 crosses itself a minimum number of times. As illustrated in FIG. 5, for example, one fiber layer 40 is created with a single fiber which crosses itself at a single location 76 generally in the longitudinal middle of the fiber layer 40. The limited crossing of the fiber reduces the potential friction between contacting fibers and minimizes the risk of lowering the performance of reinforcement layer 38 due to fiber friction. In this particular example, the filament winding machine wraps or winds the single fiber 42 in a helix pattern with the single crossing location 76; however other winding patterns may be employed. Furthermore, use of the filament winding machine facilitates maintaining a desired setting angle 78 constant along the length of the reinforcement layer 38, at least between mechanical extremities 36.

Figure 6:
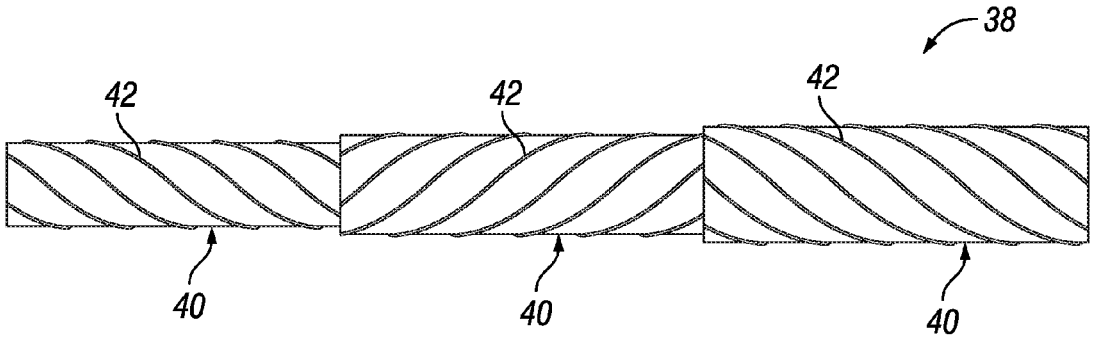
FIG. 6 is a schematic representation of a plurality of fiber layers used in constructing a reinforcement layer of the packer, according to an embodiment of the present invention.

In FIG. 6, another example is provided for creating reinforcement layer 38 with a plurality of fiber layers 40. In this example, fibers 42 are set in consecutive fiber layers 40 of unidirectional fibers. The unidirectional fiber orientation in each fiber layer 40 can be achieved by, for example, inverse packer rotation during the fiber setting stages of packer manufacture. In the specific embodiment illustrated, each consecutive fiber layer 40 is manufactured with the fiber angle set opposite to that of the angle in the radially adjacent fiber layer. In each of these examples, an individual fiber is wrapped rather than a braided fiber to reduce the number of fiber crossing points and thus to reduce the potential for friction. However, lubricant 44 also may be used along individual fibers 42 and between fiber layers 40 (in the center region between packer extremities) to reduce friction, enhance expansion functionality, and increase packer longevity.

Figure 7:
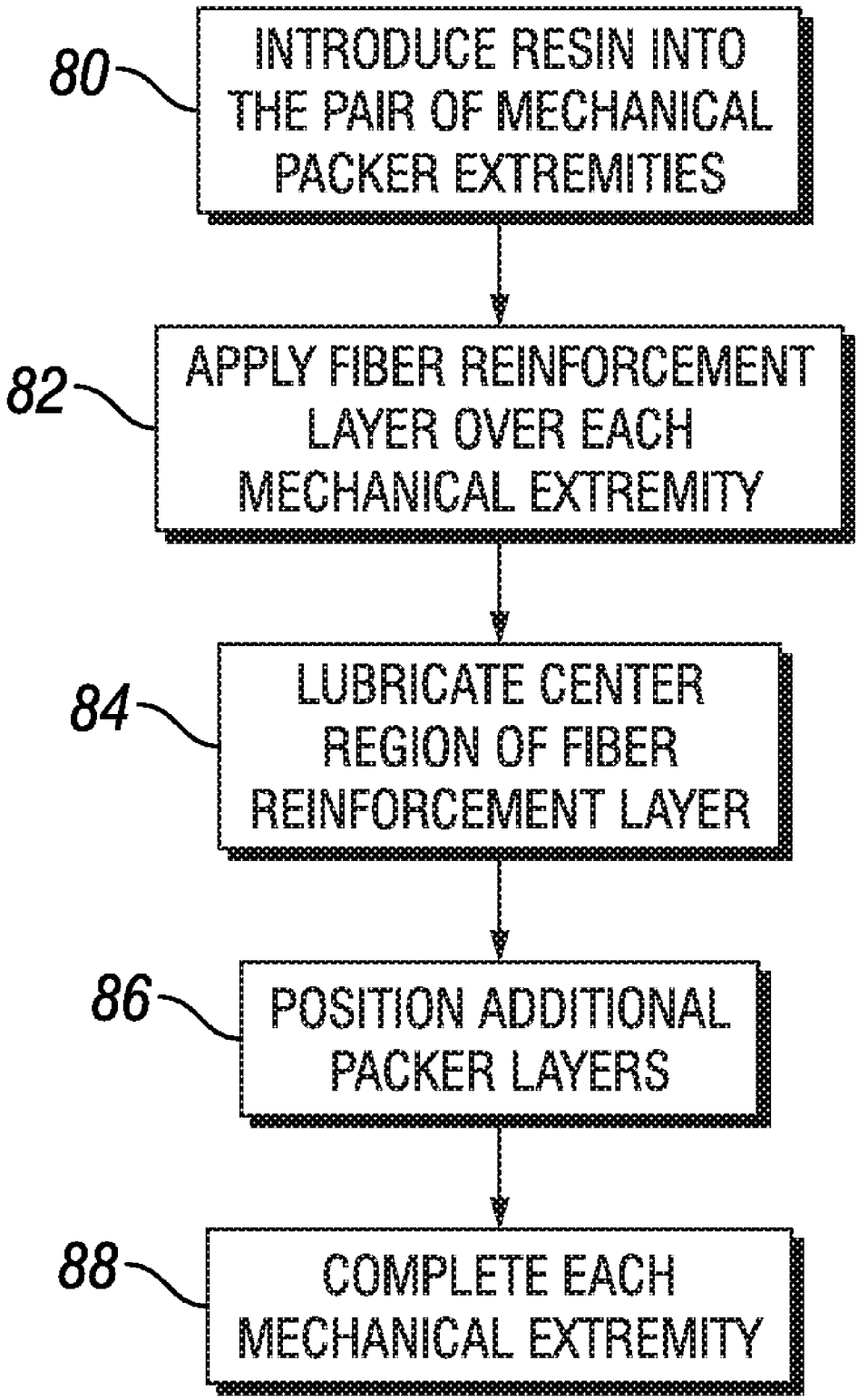
FIG. 7 is a flowchart illustrating one example of a procedure for preparing an inflatable packer, according to an embodiment of the present invention.

The packer 26 may be constructed according to a variety of techniques and with a variety of components. However, one example of packer preparation may be explained with reference to the flowchart illustrated in FIG. 7. According to this embodiment, reinforcement layer 38, formed of one or more fiber layers 40, is applied/formed/positioned over each mechanical extremity, as indicated by a block 80. For example, the fibers 42 may be wound or otherwise positioned such that the longitudinal ends of the fiber layers 40 lie within the mechanical extremities 36. Resin 68 is then introduced into each mechanical extremity, as indicated by block 82. Some resin 68 may optionally be introduced into mechanical packer extremities 36 prior to application of reinforcement layer 38. Also, additional resin and/or fiber may be applied to the longitudinal ends of reinforcement layer 38 to further impregnate the fiber layer ends with resin and to create the wedge shaped end 72, if desired.

Between mechanical extremities 36, lubrication 44 may be applied to the individual fibers 42 and/or between fiber layers 40, as indicated by block 84. Application of lubricant facilitates inflation and deflation of reinforcement layer 38 in the middle region between its resin impregnated ends held by mechanical extremities 34. The packer construction also comprises positioning the inner bladder layer 46 and may comprise the positioning of other additional layers, e.g. outer seal layer 48, as indicated by block 86. Depending on which additional layers are combined to create packer 26, the additional layers may be positioned over the mechanical extremities 36 either before or after formation of reinforcement layer 38. Once all the packer layers are in place, each mechanical extremity 36 is completed to secure the longitudinal ends of the reinforcement layer 38 and other layers of packer 26, as indicated by block 88. By way of example, each mechanical extremity may be completed by closing anti-expansion ring 60 over the inner packer nipple 54 to secure inner bladder layer 46, reinforcement layer 38, and outer seal layer 48 therebetween. Before and/or after closing each mechanical extremity 36, an additional amount of resin material 68 may be injected into each packer extremity to remove any remaining voids and to ensure that no vacuum can be created within either mechanical extremity.

In any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, inner bladder layer 46 and outer seal layer 48.

As described herein, well system 20 and packer 26 may be constructed in a variety of configurations for use in many environments and applications. The packer 26 may be constructed from many types of materials and with components/layers positioned in various arrangements. Additionally, mechanical extremity components may be constructed and arranged in different configurations to hold a variety of selected, expandable packer layers. The specific surfaces and features of the reinforcement layer and other packer layers also may be designed to enhance the ability of the mechanical extremities to securely grip the packer layers. Additionally, a variety of fiber types, winding patterns, fiber layers, setting angles, and lubricants may be employed to achieve the desired functionality for a given well application and environment. Furthermore, the packer 26 may be constructed as an inflatable packer for incorporation into a variety of completions or other types of downhole equipment.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a wellbore, comprising:
an inflatable packer comprising:
an inner bladder laver;
a reinforcement layer radially outward of the inner bladder layer, the reinforcement being formed as a plurality of fibers layers serving as an anti-extrusion layer and a mechanical layer; and
an outer seal layer radially outward of the reinforcement layer, wherein the plurality of fiber layers forming the reinforcement layer are each constructed of the same material with fiber set at a desired angle constant along an expansion region of the reinforcement layer, wherein the inflatable packer further comprises a mechanical extremity positioned at each longitudinal end of the inflatable packer to grip the inner bladder layer, the reinforcement layer, and the outer seal layer.

2. The system as recited in claim 1, wherein the fiber is carbon fiber.

3. The system as recited in claim 1, wherein the fiber layers are lubricated at a center region to facilitate packer expansion.

4. The system as recited in claim 1, wherein each fiber layer is formed with a single, continuous fiber having a setting angle constant along the expansion region of the packer, the setting angle being opposed in adjacent fiber layers.

5. The system as recited in claim 1, wherein the desired angle is changed with each mechanical extremity.

6. The system as recited in claim 1, wherein the fiber layers are impregnated with a resin at longitudinal ends of the fibers layers.

7. The system as recited in claim 1, wherein the reinforcement layer is constructed with a wedge-shaped end within each mechanical extremity to ensure retention of the reinforcement layer in each mechanical extremity during inflation of the inflatable packer.

8. The system as recited in claim 7, wherein the wedge shaped end is created by adding an extra layer of fiber at the longitudinal end of the reinforcement layer.

9. A system for use in a wellbore, comprising:
an inflatable packer comprising:
an inner bladder layer;
an outer seal layer; and a reinforcement layer positioned between the inner bladder layer and the outer seal layer to provide mechanical support and protection against extrusion, the reinforcement layer being formed with carbon fiber wherein the inflatable packer further comprises a mechanical extremity positioned at each longitudinal end of the inflatable packer to grip the inner bladder layer, the outer seal layer, and the reinforcement layer.

10. The system as recited in claim 9, wherein the reinforcement layer is constructed as a plurality of fiber layers in which each fiber layer is constructed with the carbon fiber oriented at a constant setting angle along an expandable portion of the reinforcement layer.

11. The system as recited in claim 10, wherein the carbon fiber in each fiber layer is a single fiber wound to create the fiber layer, the carbon fiber setting angle alternating between positive and negative between sequential fiber layers.

12. The system as recited in claim 9, wherein the carbon fiber is lubricated through a central region of the reinforcement layer.

13. A method of creating a packer, comprising:

introducing a resin into a pair of mechanical packer extremities;

applying a fiber reinforcement layer over the resin in each mechanical extremity such that the fiber reinforcement layer spans between the pair of mechanical extremities;

lubricating a center region of the fiber reinforcement layer; and completing each mechanical extremity so as to grip longitudinal ends of the fiber reinforcement layer.

14. The method as recited in claim 13, wherein applying comprises adding resin over the longitudinal ends of the fiber reinforcement layer to further impregnate the fiber reinforcement layer in each mechanical extremity.

15. The method as recited in claim 13, further comprising positioning an inner bladder layer to be held by the pair of mechanical extremities.

16. The method as recited in claim 15, further comprising positioning an outer seal layer to be held by the pair of mechanical extremities.

17. The method as recited in claim 13, further comprising injecting additional resin to remove empty space in each mechanical extremity after completing each mechanical extremity.

18. The method as recited in claim 13, wherein lubricating comprises applying grease.

19. A method, comprising:

forming a packer reinforcement layer with a plurality of fiber layers;

lubricating the plurality of fiber layers to facilitate packer expansion;

positioning the packer reinforcement layer between an inner bladder layer and an outer seal layer; and holding longitudinal ends of the packer reinforcement layer, the inner bladder layer, and the outer seal layer with mechanical extremities to create an inflatable packer.

20. The method as recited in claim 19, wherein forming comprises forming each fiber layer with one fiber oriented at a constant setting angle between the mechanical extremities.

21. The method as recited in claim 19, wherein forming comprises forming each fiber layer with carbon fiber.

22. The method as recited in claim 19 wherein forming comprises forming the plurality of fiber layers to serve as the sole mechanical resistance and extrusion resistance of the inflatable packer.

* * * * *